US008585038B2

(12) United States Patent
Okano

(10) Patent No.: US 8,585,038 B2
(45) Date of Patent: Nov. 19, 2013

(54) IMAGE-FORMING DEVICE CHANGING STOPPING TIME OF SHEET-SKEW CORRECTION ROLLER

(75) Inventor: Tetsuya Okano, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/483,115

(22) Filed: May 30, 2012

(65) Prior Publication Data

US 2013/0032994 A1 Feb. 7, 2013

(30) Foreign Application Priority Data

Aug. 2, 2011 (JP) ..... 2011-169004

(51) Int. Cl.
*B65H 5/26* (2006.01)

(52) U.S. Cl.
USPC ..... 271/9.09; 271/242; 399/392

(58) Field of Classification Search
USPC ..... 271/242, 110, 257, 9.09; 399/392
See application file for complete search history.

(56) References Cited

U.S. PATENT DOCUMENTS 4,337,935 A * 7/1982 Sawada et al. ..... 271/9.09
4,548,401 A * 10/1985 Nishikawa ..... 271/265.01
4,796,055 A * 1/1989 Takano et al. ..... 399/20
5,072,923 A * 12/1991 Coy ..... 271/110
5,308,054 A * 5/1994 Sugito ..... 271/9.09
5,379,994 A * 1/1995 Kushida ..... 271/9.09
7,938,393 B2 * 5/2011 Yako ..... 271/9.09
8,238,766 B2 * 8/2012 Okano ..... 399/16

FOREIGN PATENT DOCUMENTS

JP 2007-286079 11/2007

* cited by examiner

*Primary Examiner* — Kaitlin Joerger
*Assistant Examiner* — Ernesto Suarez
(74) *Attorney, Agent, or Firm* — Banner & Witcoff, Ltd.

(57) ABSTRACT

In an image-forming device the first sensor detects a recording sheet manually inserted from a manual sheet insertion opening. The sheet-skew correction roller is provided downstream side of the first sensor in the conveying direction. The controller is configured to control the sheet-skew correction roller to begin rotating if a stopping time has elapsed from a moment when the first sensor detects the recording sheet. The stopping time is initially set to a first stopping time. The controller is configured to function as a determining unit and a changing unit. The determining unit is configured to determine whether the recording sheet is properly conveyed. The changing unit is configured to change the stopping time to a second stopping time from the first stopping time if the determining unit determines that the recording sheet is not properly conveyed, the second stopping time being longer than the first stopping time.

12 Claims, 9 Drawing Sheets

IMAGE-FORMING DEVICE CHANGING STOPPING TIME OF SHEET-SKEW CORRECTION ROLLER

CROSS REFERENCE TO RELATED APPLICATION

This application claims priority from Japanese Patent Application No. 2011-169004 filed Aug. 2, 2011. The entire content of the priority application is incorporated herein by reference.

TECHNICAL FIELD

The invention relates to an image-forming device.

BACKGROUND

Conventional image-forming devices have been provided with a manual-paper-feed function for receiving a sheet of paper that the user has manually inserted through a manual-sheet-insertion opening to a pair of registration rollers and for supplying the sheet to an image-forming unit. The manual-paper-feed function suspends rotation of the registration rollers at a prescribed timing after a registration sensor detects the leading edge of the sheet manually inserted by the user. While the registration rollers are halted, the leading edge of the sheet contacts the nip point between the registration rollers, thereby correcting any skew in the paper. The manual-paper-feed function resumes rotation of the registration rollers a prescribed time after the rotation is halted and conveys the sheet to the image-forming unit. One conventional image-forming device having this function sets a rotation-stopping time for stopping rotation of the registration rollers. This conventional image-forming device sets a shorter rotation-stopping time when the paper is relatively thick (that is, the sheet will likely undergo little flexure) or when the size of the sheet is relatively small (that is, the time required to insert the sheet will be short).

SUMMARY

However, if the user of the conventional image-forming device described above is not accustomed to the manually-inserted-sheet-feeding operation, such as when the user is manually feeding a type of paper with different flexural properties from the paper ordinarily used, the sheet may not properly contact the nip point of the registration rollers while the rotation of the registration rollers is halted. Thus, the manually-inserted-sheet-feeding operation may not always be executed properly.

In view of the foregoing, it is an object of the invention to provide an image-forming device enabling a user to perform a manually-inserted-sheet-feeding operation suitably, even when the user is not accustomed to performing the operation.

In order to attain the above and other objects, the invention provides an image-forming device includes a first sensor, a sheet-skew correction roller, and a controller. The first sensor is configured to detect a recording sheet manually inserted from a manual sheet insertion opening. The image forming portion is configured to form an image on the recording sheet. The sheet-skew correction roller is configured to correct skew of the recording sheet and convey the recording sheet to the image forming portion in a conveying direction. The sheet-skew correction roller is provided downstream side of the first sensor in the conveying direction. The controller is configured to control the sheet-skew correction roller to begin rotating if a stopping time has elapsed from a moment when the first sensor detects the recording sheet. The stopping time is initially set to a first stopping time. The controller is configured to function as a determining unit and a changing unit. The determining unit is configured to determine whether the recording sheet is properly conveyed. The changing unit is configured to change the stopping time to a second stopping time from the first stopping time if the determining unit determines that the recording sheet is not properly conveyed, the second stopping time being longer than the first stopping time.

DETAILED DESCRIPTION

First Embodiment

Overall Structure of a Laser Printer

Figure 1:
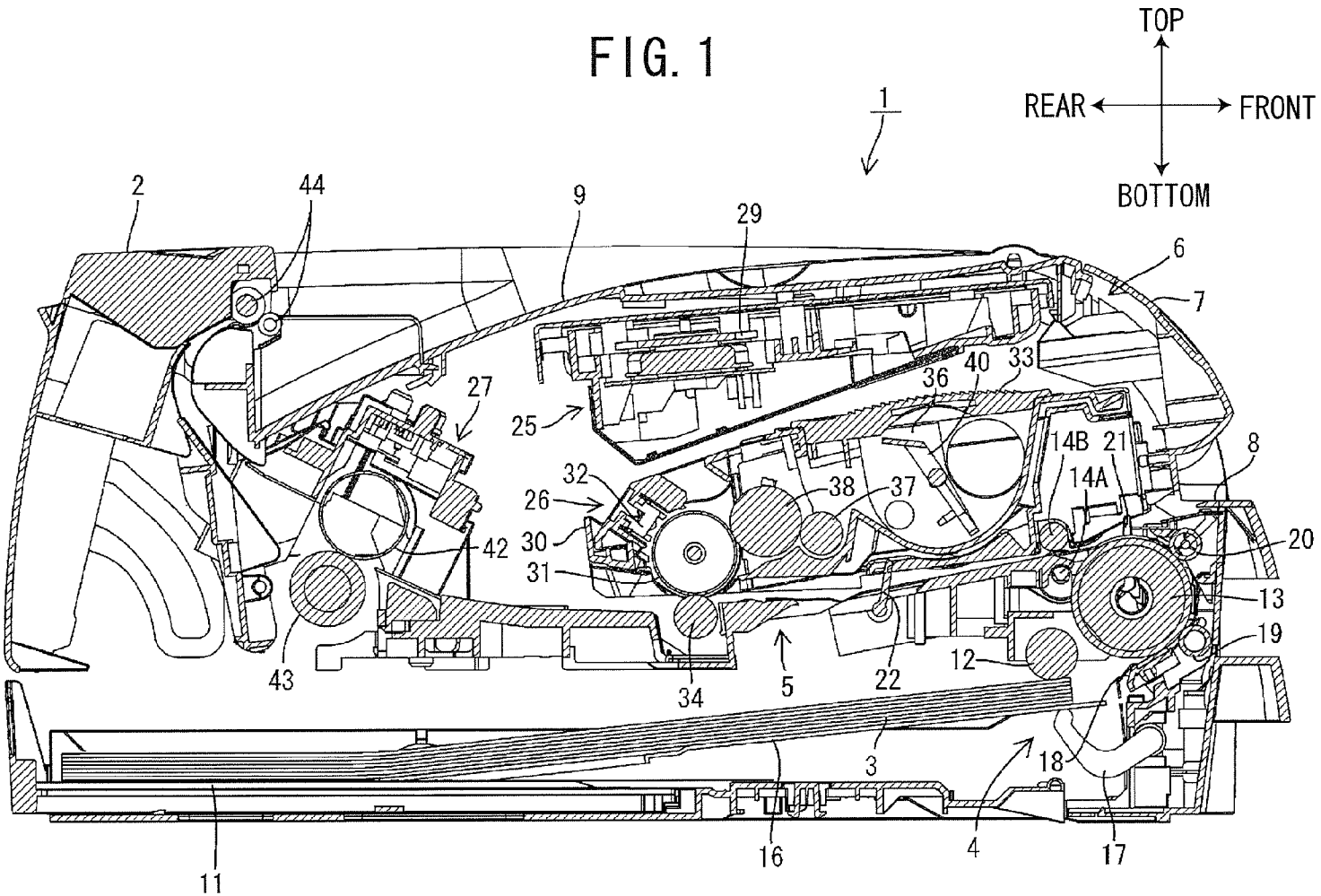
FIG. 1 is a side cross-sectional view showing a laser printer according to an embodiment an invention.

FIG. 1 is a side cross-sectional view showing a laser printer 1 serving as an example of an image-forming device of the invention. The laser printer 1 includes a main casing 2, a sheet-feeding unit 4 for feeding sheets of a paper 3 into the main casing 2, and an image-forming unit 5 for forming images on the paper 3 fed by the sheet-feeding unit 4. The terms "upward", "downward", "upper", "lower", "above", "below", "beneath", "right", "left", "front", "rear" and the like will be used throughout the description assuming that the laser printer 1 is disposed in an orientation in which it is intended to be used. In use, the laser printer 1 is disposed as shown in FIG. 1.

(1) Main Casing

A front cover 7 is provided on the front surface of the main casing 2 and is capable of being opened and closed. An access opening 6 for mounting and removing a process cartridge 26 described later is exposed in the main casing 2 when the front cover 7 is opened. A manual-sheet-insertion opening 8 is formed beneath the front cover 7 for manually inserting a sheet of paper 3 into the main casing 2. A discharge tray 9 is provided on the top surface of the main casing 2 for receiving and holding sheets of paper 3 that have undergone an image-forming operation.

(2) Sheet-Feeding Unit

The sheet-feeding unit 4 includes a paper tray 11 disposed in the bottom section of the main casing 2 for accommodating a plurality of sheets of the paper 3, a pick-up roller 12 disposed above the front end of the paper tray 11, a feeding roller 13 disposed obliquely above and forward of the pick-up roller 12, and a pair of sheet-skew correction rollers 14A and 14B disposed obliquely above and rearward of the feeding roller 13. As described below, the sheet-skew correction rollers 14A and 14B are registration rollers correcting a skew of sheet. The sheet-feeding unit 4 functions to supply sheets of the paper 3 accommodated in the paper tray 11 and sheets of paper 3 inserted manually through the manual-sheet-insertion opening 8 to the image-forming unit 5.

The paper tray 11 can be pulled forward out of the main casing 2. A paper-pressing plate 16 is pivotably disposed on the bottom of the paper tray 11 near the front side thereof. A lever 17 is rotatably provided on the front end portion of the paper tray 11. The urging force of the lever 17 lifts the front end of the paper-pressing plate 16 upward, pressing the sheets of paper 3 resting on the top surface of the paper-pressing plate 16 against the pick-up roller 12.

A separating pad 18 is disposed beneath the feeding roller 13 and elastically contacts the same. When the pick-up roller 12 is driven to rotate while the sheets of paper 3 on the paper-pressing plate 16 are pressed against the pick-up roller 12, the pick-up roller 12 conveys sheets of paper 3 between the feeding roller 13 and the separating pad 18. When the sheets of paper 3 become interposed between the feeding roller 13 and the separating pad 18, the topmost sheet is separated from other sheets and conveyed downstream in the paper-conveying direction by the rotating feeding roller 13.

A pinch roller 19 and a paper-dust roller 20 are provided around the circumference of the feeding roller 13 downstream of the separating pad 18 in the paper-conveying direction. The pinch roller 19 and the paper-dust roller 20 contact and apply pressure to the feeding roller 13. A sheet of paper 3 conveyed downstream from the separating pad 18 in the paper-conveying direction passes between the feeding roller 13 and the pinch roller 19 and subsequently the feeding roller 13 and the paper-dust roller 20. While passing between the feeding roller 13 and the paper-dust roller 20, the paper-dust roller 20 removes paper dust from the surface of the sheet, and the feeding roller 13 continues to convey the sheet toward the sheet-skew correction rollers 14A and 14B.

A paper-conveying path extending from the paper tray 11 to the sheet-skew correction rollers 14A and 14B and a paper-conveying path extending from the manual-sheet-insertion opening 8 to the sheet-skew correction rollers 14A and 14B converge above the feeding roller 13. A manual-paper-feed sensor 21 is provided near this converging point for detecting the presence of a sheet of paper 3.

Figure 3:
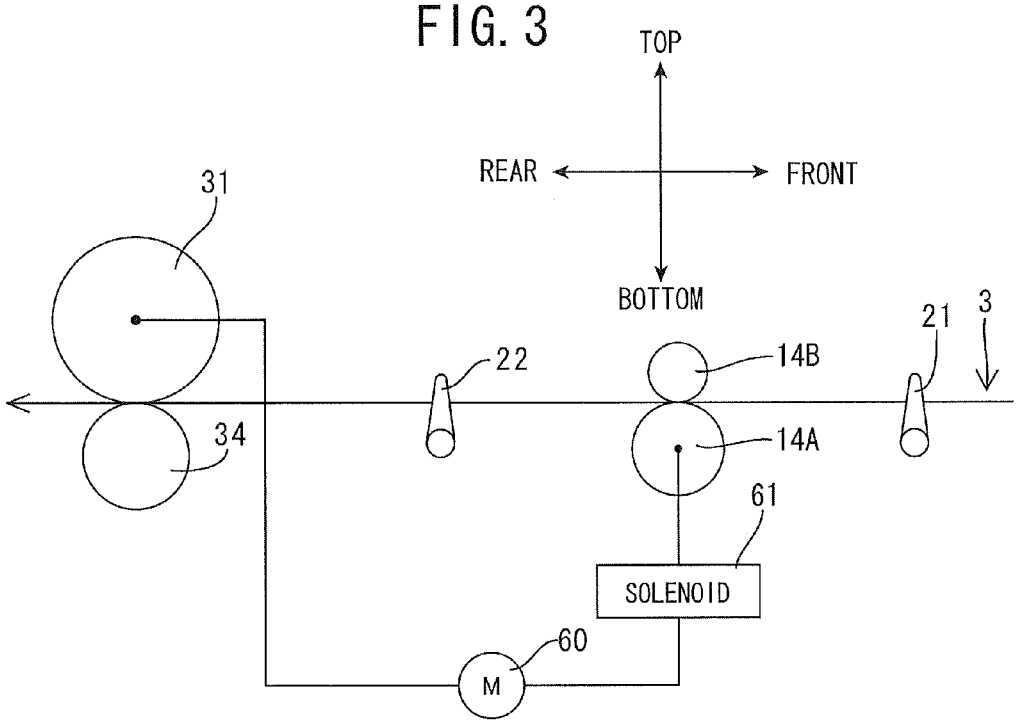
FIG. 3 is a simple diagram of a manual sheet-feeding mechanism.

Next, the mechanism for feeding a sheet of paper 3 to the image-forming unit 5 when the sheet is inserted through the manual-sheet-insertion opening 8 will be described with reference to FIG. 3. FIG. 3 is a simple diagram of the manual sheet-feeding mechanism.

When a sheet of paper 3 is inserted through the manual-sheet-insertion opening 8, the sheet of paper 3 is subsequently conveyed by the sheet-skew correction roller 14A. In this case, the sheet sequentially passes over the manual-paper-feed sensor 21, a nip between the sheet-skew correction rollers 14A and 14B, over a post-registration sensor 22, and a nip between a photosensitive drum 31 and a transfer roller 34, in this order. As shown in FIG. 3, the sheet-skew correction rollers 14A and 14B are disposed downstream of the manual-paper-feed sensor 21. The sheet-skew correction roller 14A is driven to rotate by a main motor 60 described later. The sheet-skew correction roller 14B contacts the top of the sheet-skew correction roller 14A with pressure and follows the rotation of the same. A solenoid 61 described later functions to transmit and interrupt the drive force of the main motor 60 for the sheet-skew correction roller 14A. The post-registration sensor 22 is provided downstream of the sheet-skew correction rollers 14A and 14B for detecting the presence of the paper 3. The photosensitive drum 31 and the transfer roller 34 provided in the image-forming unit 5 described later are disposed in confrontation with each other at a position downstream of the post-registration sensor 22. When the sheet of paper 3 conveyed by the sheet-skew correction rollers 14A and 14B passes through a transfer position (that is, the nip position) between the photosensitive drum 31 and the transfer roller 34, a toner image carried on the photosensitive drum 31 is transferred to the paper 3.

Figure 4A:
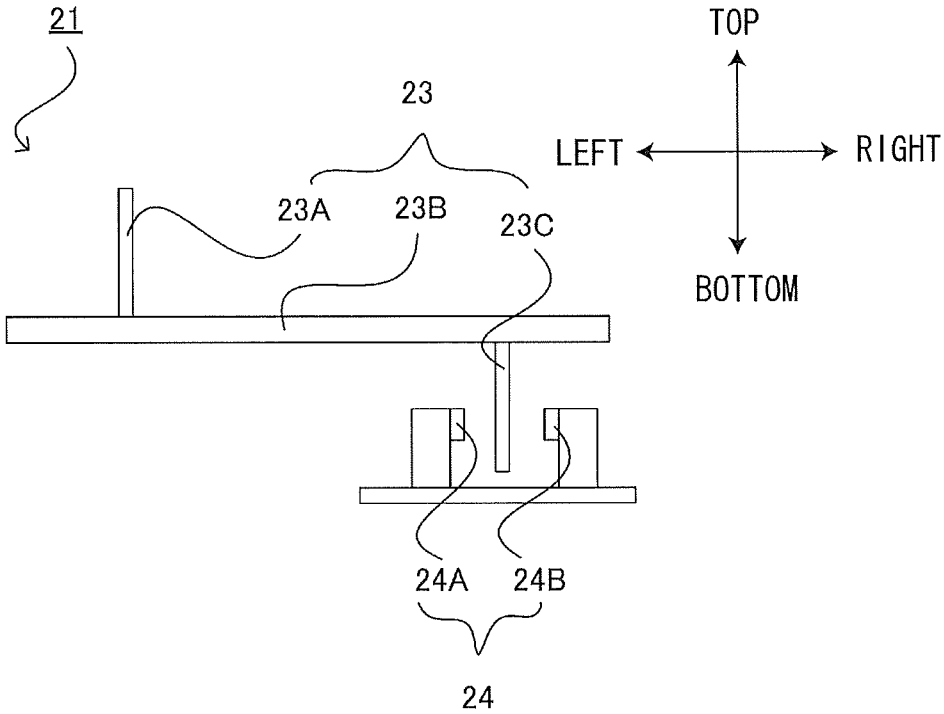
FIG. 4*a* is a front view showing a structure of a manual-paper-feed sensor.

Next, the manual-paper-feed sensor 21 will be described with reference to FIG. 4*a*. FIG. 4*a* is a front view showing the structure of the manual-paper-feed sensor 21 in an initial state prior to manual insertion of the paper 3. The manual-paper-feed sensor 21 is configured of an actuator 23 that is rotated while contacted by a sheet of paper 3 passing along the paper-conveying path, and a photointerrupter 24 for detecting the rotated state of the actuator 23. The photointerrupter 24 has a light-emitting diode 24A for irradiating light, and a phototransistor 24B for receiving light emitted from the light-emitting diode 24A. The light-emitting diode 24A and the phototransistor 24B are disposed in opposition at a prescribed distance from each other and are arranged such that light emitted from the light-emitting diode 24A to the phototransistor 24B travels parallel to the axis of a rotational shaft 23B (described later) of the actuator 23. The actuator 23 interrupts light emitted from the light-emitting diode 24A so that the light is not incident on the phototransistor 24B.

The actuator 23 has a rotary body 23A, a rotational shaft 23B, and a light-shielding plate 23C. The rotary body 23A is rotated by contact from the paper 3 as the paper 3 passes along the paper-conveying path about the rotational shaft 23B. The rotational shaft 23B rotates along with the rotation of the rotary body 23A. The light-shielding plate 23C extends in a direction orthogonal to the axial direction of the rotational shaft 23B and rotates into a position for shielding the phototransistor 24B from receiving light. The rotary body 23A reciprocates between an initial position when the rotary body 23A is not contacted by the paper 3, and a rotated position when the paper 3 is passing over the manual-paper-feed sensor 21. The light-shielding plate 23C reciprocates in response to the rotation of the rotational shaft 23B and moves in the same rotational direction. Once the paper 3 has passed over the manual-paper-feed sensor 21 so that the paper 3 no longer contacts the rotary body 23A, the actuator 23 is returned to its original position by a spring of other urging force (not shown). The light-shielding plate 23C returns to its original position together with the rotation of the rotational shaft 23B.

While the paper 3 is passing over the manual-paper-feed sensor 21, the rotary body 23A remains rotated, allowing the phototransistor 24B to receive light ordinarily shielded by the light-shielding plate 23C. When the phototransistor 24B receives light, the manual-paper-feed sensor 21 is in its ON state. In the ON state, the manual-paper-feed sensor 21 is detecting the presence of a sheet of paper 3. Once the trailing edge of the sheet passes over the manual-paper-feed sensor 21, the rotary body 23A rotates back to its original position, and the light-shielding plate 23C once again blocks light from reaching the phototransistor 24B. When light is shielded from reaching the phototransistor 24B, the manual-paper-feed sensor 21 is in its OFF state. In the OFF state, the manual-paper-feed sensor 21 is not detecting the presence of a sheet of paper 3.

Figure 4B:
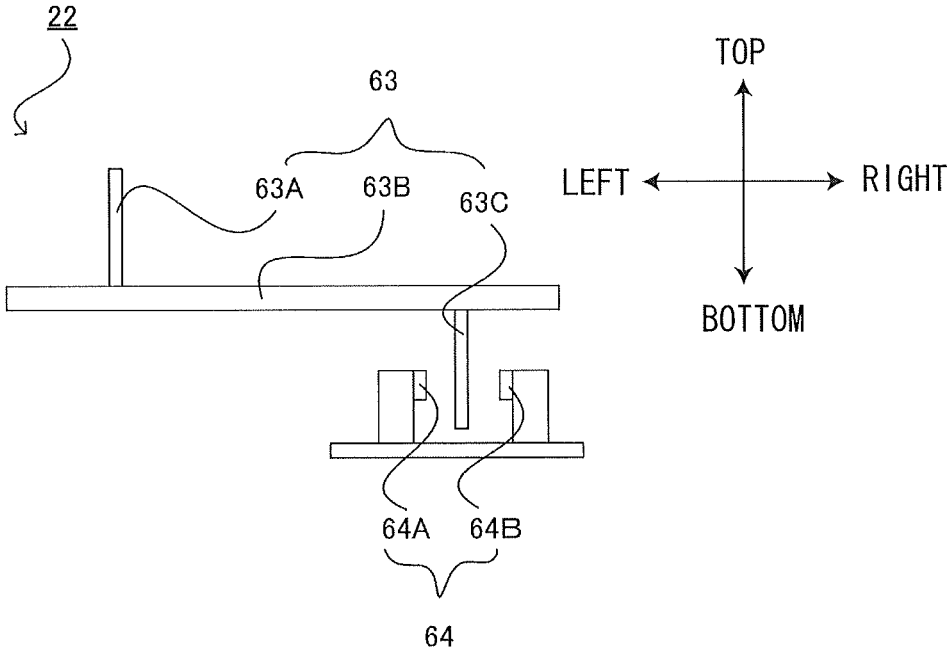
FIG. 4*b* is a front view showing a structure of a post-registration sensor.

Next, the post-registration sensor 22 will be described with reference to FIG. 4*b*. FIG. 4*b* is a front view showing the structure of the post-registration sensor 22 in its state before a sheet of paper 3 is initially conveyed. The post-registration sensor 22 is configured of an actuator 63 that is rotated while contacted by a sheet of paper 3 passing along the paper-conveying path, and a photointerrupter 64 for detecting the rotated state of the actuator 63. The photointerrupter 64 has a light-emitting diode 64A for irradiating light, and a phototransistor 64B for receiving light emitted from the light-emitting diode 64A. The light-emitting diode 64A and the phototransistor 64B are disposed in opposition at a prescribed distance from each other and are arranged such that light emitted from the light-emitting diode 64A to the phototransistor 64B travels parallel to the axis of a rotational shaft 63B (described later) of the actuator 63. The actuator 63 interrupts light emitted from the light-emitting diode 64A so that the light is not incident on the phototransistor 64B.

The actuator 63 has a rotary body 63A, a rotational shaft 63B, and a light-shielding plate 63C. The rotary body 63A is rotated by contact from the paper 3 as the paper 3 passes along the paper-conveying path about the rotational shaft 63B. The rotational shaft 63B rotates along with the rotation of the rotary body 63A. The light-shielding plate 63C extends in a direction orthogonal to the axial direction of the rotational shaft 63B and rotates into a position for shielding the phototransistor 64B from receiving light. The rotary body 63A reciprocates between an initial position when the rotary body 63A is not contacted by the paper 3, and a rotated position when the paper 3 is passing over the post-registration sensor 22. The light-shielding plate 63C reciprocates in response to the rotation of the rotational shaft 63B and moves in the same rotational direction. Once the paper 3 has passed over the post-registration sensor 22 so that the paper 3 no longer contacts the rotary body 63A, the actuator 63 is returned to its original position by a spring of other urging force (not shown). The light-shielding plate 63C returns to its original position together with the rotation of the rotational shaft 63B.

While the paper 3 is passing over the post-registration sensor 22, the rotary body 63A remains rotated, allowing the phototransistor 64B to receive light ordinarily shielded by the light-shielding plate 63C. When the phototransistor 64B receives light, the post-registration sensor 22 is in its ON state. In the ON state, the post-registration sensor 22 is detecting the presence of a sheet of paper 3. Once the trailing edge of the sheet passes over the post-registration sensor 22, the rotary body 63A rotates back to its original position, and the light-shielding plate 63C once again blocks light from reaching the phototransistor 64B. When light is shielded from reaching the phototransistor 64B, the post-registration sensor 22 is in its OFF state. In the OFF state, the post-registration sensor 22 is not detecting the presence of a sheet of paper 3.

(3) Image-Forming Unit

The image-forming unit 5 includes a scanning unit 25, a process cartridge 26, and a fixing unit 27.

(a) Scanning Unit

The scanning unit 25 is disposed in the top section of the main casing 2. The scanning unit 25 includes a laser light source (not shown) that emits a laser beam, a polygon mirror 29 that is driven to rotate, and a plurality of lenses and reflecting mirrors (not shown). Light is irradiated from the laser light source based on image data, reflected off the polygon mirror 29, and passed through the various lenses and reflected off the various reflecting mirrors to be irradiated onto the surface of a photosensitive drum 31 included in the process cartridge 26.

(b) Process Cartridge

The process cartridge 26 is detachably mounted in the main casing 2 beneath the scanning unit 25. The process cartridge 26 includes a frame 30 and, disposed within the frame 30, the photosensitive drum 31, a Scorotron charger 32, a developer cartridge 33, and a transfer roller 34.

The photosensitive drum 31 is configured of a metal main drum body that is grounded, the outer surface of which is coated with a positive-charging photosensitive layer formed of polycarbonate or the like. The Scorotron charger 32 produces a corona discharge from a charging wire (not shown) formed of tungsten or the like in order to form a uniform charge of positive polarity over the surface of the photosensitive drum 31.

The developer cartridge 33 has a box shape with an open rear side and is detachably mounted in the frame 30. Disposed within the frame 30 are a toner-accommodating chamber 36, a supply roller 37, and a developing roller 38. The toner-accommodating chamber 36 is filled with a positive-charging, nonmagnetic, single-component toner. An agitator 40 is provided inside the toner-accommodating chamber 36 for agitating the toner.

The supply roller 37 is configured of a metal roller shaft coated with an electrically conductive foam material. The developing roller 38 is configured of a metal roller shaft coated with an electrically conductive rubber material. During a developing operation, toner discharged from the toner-accommodating chamber 36 is supplied onto the developing roller 38 by the rotating supply roller 37. At this time, the toner is positively tribocharged between the supply roller 37 and the developing roller 38. As the developing roller 38 continues to rotate, the toner supplied onto the developing roller 38 passes beneath a thickness-regulating blade (not shown) contacting the surface of the developing roller 38 with pressure, which further tribocharges the toner and forms a thin layer of uniform thickness on the developing roller 38.

The transfer roller 34 is configured of a metal roller shaft covered with a roller formed of an electrically conductive rubber material. A transfer bias is applied to the transfer roller 34 during a transfer operation.

The Scorotron charger 32 charges the surface of the photosensitive drum 31 with a uniform positive polarity. Subsequently, a laser beam emitted from the scanning unit 25 is scanned at a high speed over the surface of the photosensitive drum 31, forming an electrostatic latent image corresponding to an image to be formed on the paper 3.

Next, positively charged toner carried on the surface of the developing roller 38 comes into contact with the photosensitive drum 31 as the developing roller 38 rotates and is supplied to the electrostatic latent image formed on the surface of the photosensitive drum 31. In this way, the latent image on the photosensitive drum 31 is developed into a visible image. Thus, a toner image is carried on the surface of the photosensitive drum 31. That is, the toner image is configured of toner deposited only in exposed portions of the photosensitive drum 31.

Subsequently, the toner image carried on the surface of the photosensitive drum 31 is transferred onto a sheet of paper 3 by a negative transfer bias applied to the transfer roller 34 as the sheet passes through the transfer position between the photosensitive drum 31 and transfer roller 34. After the toner image is transferred, the sheet of paper 3 is conveyed to the fixing unit 27.

(c) Fixing Unit

The fixing unit 27 is provided with a heating roller 42, and a pressure roller 43. The heating roller 42 is provided with a halogen lamp or other heat source and is driven to rotate. The pressure roller 43 is disposed in confrontation with the heating roller 42 and applies pressure to the same. When a sheet of paper 3 is conveyed to the fixing unit 27, the heating roller 42 and the pressure roller 43 grip and convey the sheet while applying heat to the toner image to fix the toner image to the sheet. Discharge rollers 44 disposed in the top section of the main casing 2 downstream of the fixing unit 27 in the paper-conveying direction receive and convey the sheet of paper 3, discharging the sheet onto the discharge tray 9.

Electrical Structure of the Laser Printer

Figure 2:
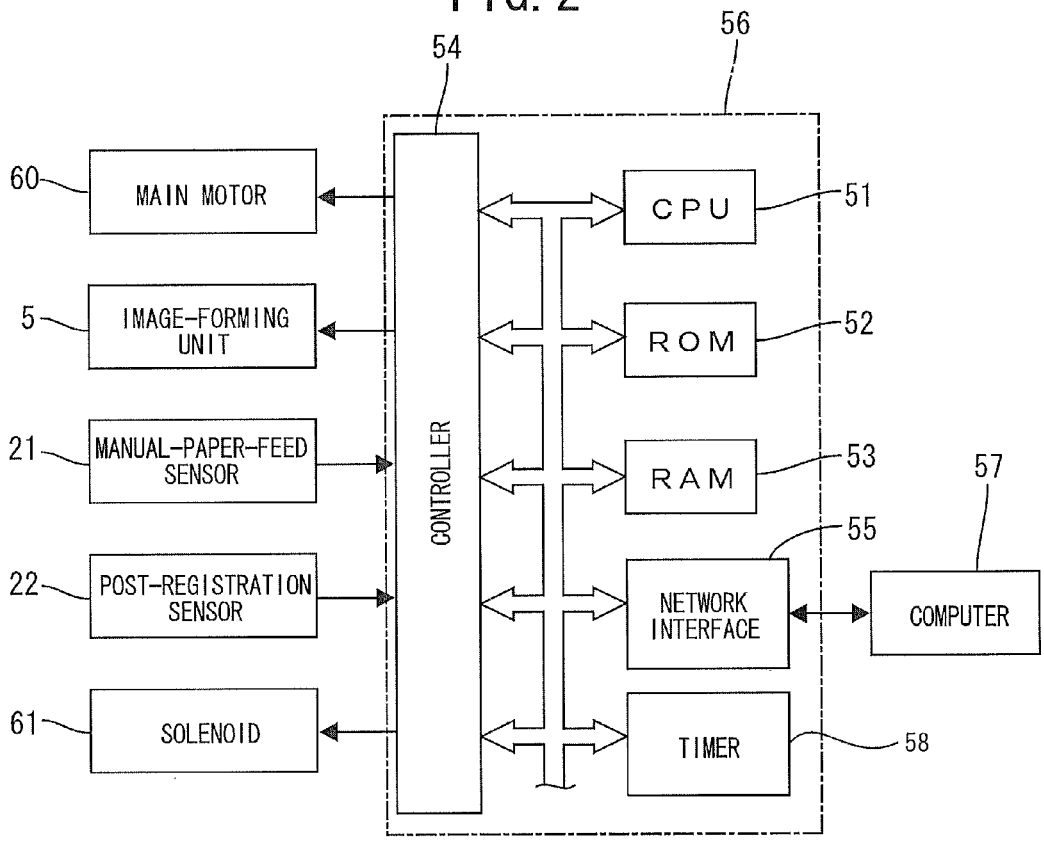
FIG. 2 is a block diagram conceptually illustrating the electrical structure of the laser printer.

Next, the electrical structure of the laser printer 1 will be described. FIG. 2 is a block diagram conceptually illustrating the electrical structure of the laser printer 1.

The laser printer 1 includes a control device 56 provided with a CPU 51, a ROM 52, a RAM 53, a controller 54, a network interface 55, and a timer 58. The ROM 52 stores various control programs (described later), settings, initial values, and the like for controlling the laser printer 1. The RAM 53 serves as a work area into which the various control programs are read, or a storage area for temporarily storing print data. The timer 58 keeps track of the time during which the rotation of the sheet-skew correction roller 14A is suspended.

The CPU 51 stores results of processes in the RAM 53 while controlling the components of the laser printer 1 via the controller 54 according to the various control programs (described later) read from the ROM 52. The control programs stored in the ROM 52 include a manually-inserted-sheet-feeding program, a paper-withdrawal monitoring program, a rotation-stopping-time setting program, and a print-success determining program. These control programs will be described later.

The network interface 55 connects to an external device, such as a computer 57, in order to receive print commands, print data, and the like transmitted from the computer 57.

The controller 54 is configured of an application-specific integrated circuit (ASIC) and is electrically connected to the various components of the laser printer 1, including a main motor 60, a solenoid 61, and the previously mentioned image-forming unit 5, manual-paper-feed sensor 21, and post-registration sensor 22. The controller 54 controls these components of the laser printer 1 according to the control programs.

The main motor 60 is connected to the pick-up roller 12, the feeding roller 13, the sheet-skew correction roller 14A, the developing roller 38, the photosensitive drum 31, the heating roller 42, the discharge rollers 44, and the like described above via a gear mechanism (not shown), and drives each of these components to rotate in synchronization. The solenoid 61 is provided between the main motor 60 and the sheet-skew correction roller 14A as a clutch mechanism. The solenoid 61 has an OFF state for transmitting a drive force from the main motor 60 to the sheet-skew correction roller 14A, and an ON state for interrupting transmission of this drive force.

The manual-paper-feed sensor 21 outputs an ON state to the controller 54 when detecting the presence of a sheet of paper 3, and outputs an OFF state to the controller 54 when not detecting the presence of a sheet of paper 3. Similarly, the post-registration sensor 22 outputs an ON state to the controller 54 when detecting the presence of a sheet of paper 3 and outputs an OFF state to the controller 54 when not detecting the presence of a sheet of paper 3.

Operations of the Solenoid

Next, the operations of the solenoid 61 during a manually-inserted-sheet-feeding operation will be described. The manually-inserted-sheet-feeding operation begins when the user inserts a sheet of paper 3 into the manual-sheet-insertion opening 8 and the manual-paper-feed sensor 21 detects the sheet. Upon detecting the sheet of paper 3, the manual-paper-feed sensor 21 outputs an ON state, placing the solenoid 61 in the ON state for exactly a rotation-stopping time described later. For this rotation-stopping time, the solenoid 61 interrupts transmission of the drive force from the main motor 60 to the sheet-skew correction roller 14A. Since the drive transmission to the sheet-skew correction roller 14A is interrupted prior to the sheet of paper 3 arriving at the sheet-skew correction rollers 14A and 14B, the inserted sheet of paper 3 collides with the sheet-skew correction rollers 14A and 14B in their halted state. The sheet flexes upon contacting the sheet-skew correction rollers 14A and 14B, correcting skew in the sheet relative to the direction of insertion. That is, by contacting the sheet-skew correction rollers 14A and 14B, the leading edge of the sheet is arranged to extend in a direction orthogonal to the conveying direction. The rotation-stopping time is set according to the rotation-stopping time setting program described later. The rotation-stopping time is set to the estimated time required for completing skew correction in the paper 3.

The solenoid 61 switches from the ON state to the OFF state when the rotation-stopping time has elapsed. Upon entering its OFF state, the solenoid 61 allows transmission of the drive force to the sheet-skew correction roller 14A so that the sheet-skew correction rollers 14A and 14B pull the sheet of paper 3 inward after the skew has been corrected. The solenoid 61 switches again from the OFF state to the ON state after the sheet is pulled inward by the sheet-skew correction rollers 14A and 14B, and the leading edge of the sheet is gripped by the same. With the leading edge of the sheet gripped between the sheet-skew correction rollers 14A and 14B, the solenoid 61 is maintained in the ON state until a print command is received and the sheet can be conveyed. Once the sheet of paper 3 is able to be conveyed, the solenoid 61 switches from the ON state to the OFF state, allowing transmission of the drive force to the sheet-skew correction roller 14A for initiating conveyance of the sheet.

Manually-Inserted-Sheet-Feeding Operation

Figure 9:
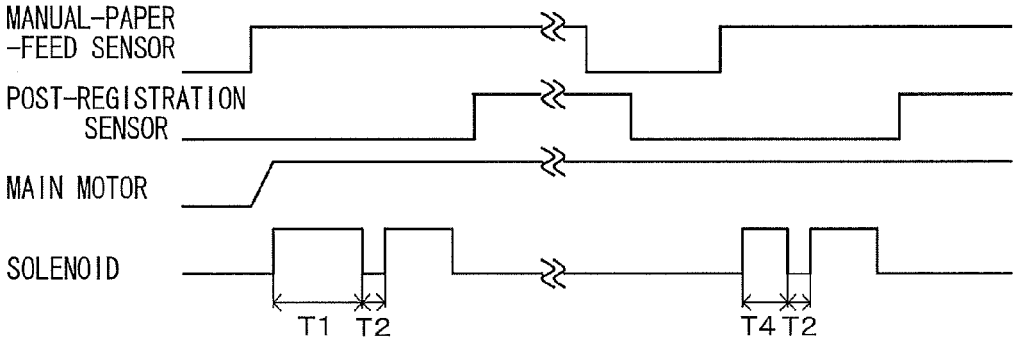
FIG. 9 is a timing chart showing operations of the manual-paper-feed sensor, the post-registration sensor, a main motor and a solenoid when consecutive manually-inserted-sheet-feeding operations are performed successfully.

Next, the manually-inserted-sheet-feeding operation will be described with reference to FIGS. 3 and 9. FIG. 9 is a timing chart showing operations of the manual-paper-feed sensor 21, the post-registration sensor 22, the main motor 60 and the solenoid 61 when consecutive manually-inserted-sheet-feeding operations are performed successfully. When the user inserts a sheet of paper 3 through the manual-sheet-insertion opening 8 and the leading edge of the paper 3 passes over the manual-paper-feed sensor 21, the manual-paper-feed sensor 21 detects the presence of the paper 3. Since the drive transmission to the sheet-skew correction roller 14A is interrupted when the manual-paper-feed sensor 21 detects the presence of the sheet of paper 3, the sheet collides with the sheet-skew correction rollers 14A and 14B in their halted state. The user presses the sheet against the sheet-skew correction rollers 14A and 14B until the sheet-skew correction roller 14A draws the sheet inward. When the sheet is drawn between the sheet-skew correction rollers 14A and 14B and the leading edge of the paper 3 is pinched therebetween, the sheet of paper 3 has been manually inserted by the user to a position from which the sheet can be fed.

After the sheet of paper 3 is pinched by the sheet-skew correction rollers 14A and 14B, the user performs an operation on the external computer 57 to issue a print command. Upon receiving this print command, the laser printer 1 begins the manually-inserted-sheet-feeding operation for the paper 3. As the paper 3 is conveyed by the sheet-skew correction rollers 14A and 14B and the leading edge of the paper 3 passes over the post-registration sensor 22, the post-registration sensor 22 detects the presence of the sheet. The laser printer 1 adjusts the timing for irradiating a laser beam from the scanning unit 25 based on this detection timing and begins to expose the photosensitive drum 31. The laser printer 1 transfers an image based on print data received from the computer 57 onto the sheet of paper 3 as the sheet passes between the photosensitive drum 31 and the transfer roller 34.

Manually-Inserted-Sheet-Feeding Program

Figure 5:
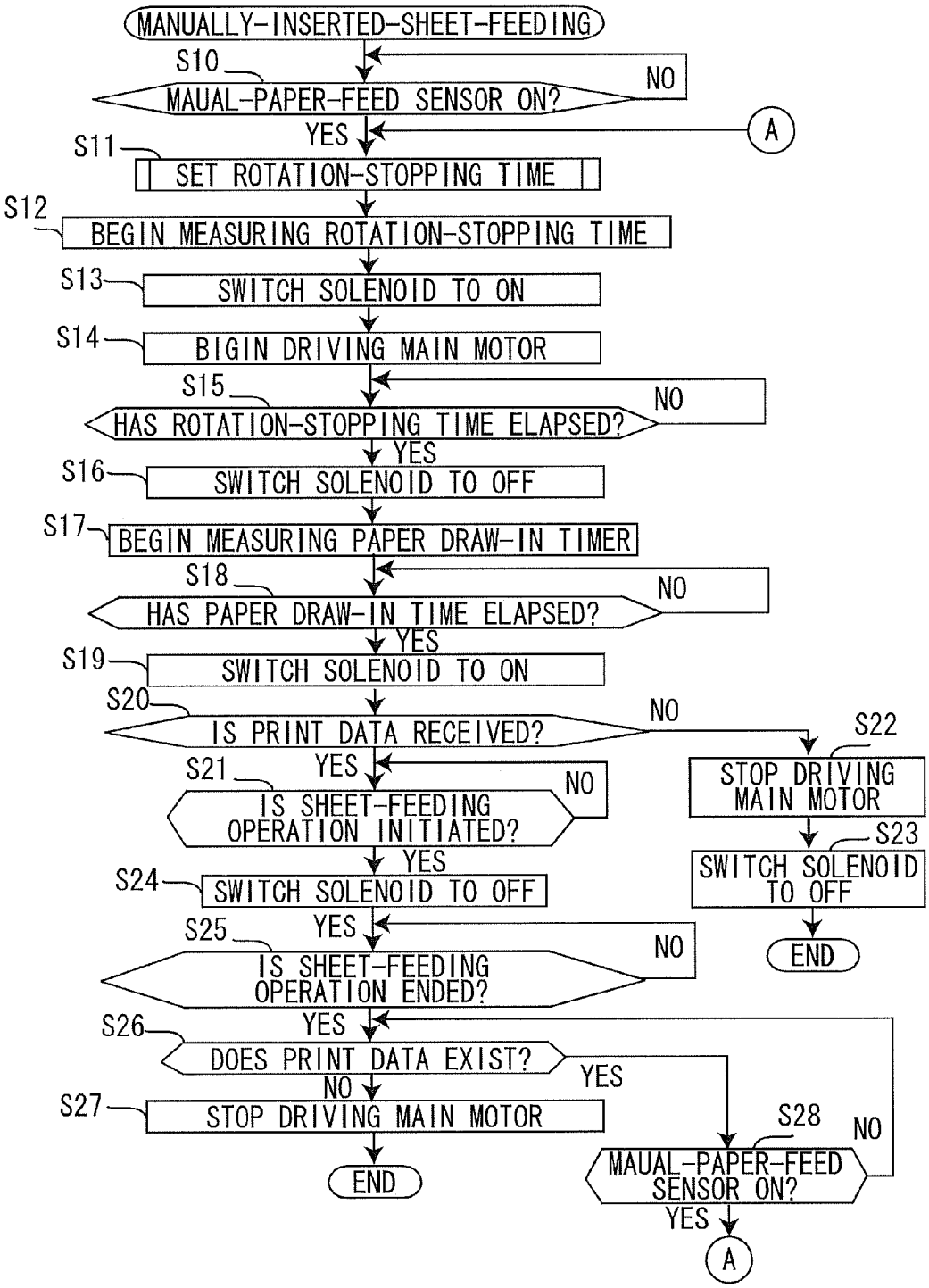
FIG. 5 is a flowchart illustrating steps in a process implemented by a manually-inserted-sheet-feeding program.

Next, a manually-inserted-sheet-feeding program for feeding a sheet of paper 3 inserted through the manual-sheet-insertion opening 8 will be described with reference to FIGS. 3, 5, and 9. FIG. 5 is a flowchart illustrating steps in the process implemented by the manually-inserted-sheet-feeding program. The program serves to feed a sheet of paper 3 inserted manually through the manual-sheet-insertion opening 8 to the image-forming unit 5 for an image-forming process.

The CPU 51 of the laser printer 1 executes the manually-inserted-sheet-feeding program shown in FIG. 5 when the power for the laser printer 1 is turned on. At the beginning of the process implemented by the manually-inserted-sheet-feeding program, in S10 the CPU 51 begins monitoring whether a sheet of paper 3 has been inserted manually through the manual-sheet-insertion opening 8 based on the manual-paper-feed sensor 21. When a sheet of paper 3 has been inserted through the manual-sheet-insertion opening 8 and detected by the manual-paper-feed sensor 21 (S10: YES), in S11 the CPU 51 sets a rotation-stopping time for the sheet-skew correction rollers 14A and 14B according to a rotation-stopping time setting program described later. The rotation-stopping time is the time required to correct skew in the paper 3, and more specifically the time required for the leading edge of the paper 3 collides with the sheet-skew correction rollers 14A and 14B in their halted state (i.e., while the sheet-skew correction rollers 14A and 14B are stopped from rotating), causes the paper 3 to flex, and corrects skew in the same, from the point when the manual-paper-feed sensor 21 detects the paper 3.

In S12 the timer 58 begins measuring the rotation-stopping time for the sheet-skew correction roller 14A. In S13 the CPU 51 switches the solenoid 61 from its OFF state to its ON state. Upon entering its ON state, the solenoid 61 interrupts transmission of the drive force from the main motor 60 for driving the sheet-skew correction roller 14A, thereby placing the sheet-skew correction roller 14A in its halted state. When the leading edge of the paper 3 butts against the halted sheet-skew correction rollers 14A and 14B, the contact corrects skew in the paper 3.

Further, after the solenoid 61 enters the ON state, in S14 the CPU 51 begins driving the main motor 60. As a result, the main motor 60 begins rotating from a halted state, its rotational speed gradually increasing up to a prescribed speed. Upon reaching the prescribed speed, the main motor 60 continues to rotate at this prescribed speed. The feeding roller 13, the sheet-skew correction roller 14A, the photosensitive drum 31, and the like are also driven to rotate by the rotation of the main motor 60. The above description assumes that the main motor 60 is in a halted state, such as when the power to the laser printer 1 is first turned on, and is gradually rotated from this halted state to the prescribed speed. However, if the main motor 60 is already rotating at the prescribed speed, the process of S14 serves to continue driving the main motor 60 to rotate at the same speed.

When the rotation-stopping time measured by the timer 58 beginning from S12 exceeds the rotation-stopping time set in S11 (S15: YES), in S16 the CPU 51 switches the solenoid 61 to its OFF state and in S17 controls the timer 58 to begin measuring a paper draw-in time for the paper 3. When the solenoid 61 is switched to the OFF state, the drive force of the main motor 60 is once again transmitted to the sheet-skew correction roller 14A, driving the sheet-skew correction roller 14A to rotate. When the sheet-skew correction roller 14A rotates, the sheet of paper 3 abutting the sheet-skew correction rollers 14A and 14B is pinched by the same and pulled into the main casing 2. The user releases the paper 3 as the sheet is drawn into the main casing 2. The solenoid 61 is maintained in the OFF state while a prescribed paper draw-in time T2 has not elapsed (S18: NO). When the prescribed paper draw-in time T2 has elapsed (S18: YES), in S19 the CPU 51 switches the solenoid 61 to the ON state, when the solenoid 61 is switched to the ON state, the rotation of the sheet-skew correction rollers 14A and 14B halts, stopping the leading edge of the paper 3 drawn into the main casing 2 at a position just prior to the post-registration sensor 22.

In S20, the CPU 51 determines whether the print data is received from the external computer 57. Upon receiving print data from the external computer 57 (S20: YES), in S21 the CPU 51 determines whether a sheet-feeding operation for performing a print has been initiated. If the sheet-feeding operation has begun (S21: YES), in S24 the CPU 51 switches the solenoid 61 to the OFF state, thereby rotating the sheet-skew correction roller 14A. The rotation of the sheet-skew correction roller 14A conveys the paper 3 halted with its leading edge positioned just before the post-registration sensor 22 toward the image-forming unit 5. In S25 the CPU 51 determines whether the sheet-feeding operation has ended. If the post-registration sensor 22 detects the trailing edge of the paper 3, the CPU 51 determines that the sheet-feeding operation has ended (S25: YES). After determining that the sheet-feeding operation has been ended, in S26 the CPU 51 determines whether there exists print data for printing another sheet to be manually fed. If the CPU 51 determines that there is no more print data (S26: NO), in S27 the CPU 51 stops driving the main motor 60 after the current print has completed and ends the process implemented by the manually-inserted-sheet-feeding program. On the other hand, if the CPU 51 determines that there exists print data for a subsequent sheet (S26: YES), in S28 the CPU 51 enters a state for detecting insertion of the next sheet of paper 3. That is, in S28 the CPU 51 determines whether the manual-paper-feed sensor 21 is in the ON state. If the manual-paper-feed sensor 21 is not in the ON state (S28: NO), the CPU 51 remains in a state for detecting insertion of the paper 3 by repeating the processes in S26 and S28 until the manual-paper-feed sensor 21 is in the ON state. When a sheet of paper 3 is inserted and the CPU 51 determines that the manual-paper-feed sensor 21 is in the ON state (S28: YES), the CPU 51 returns to the process in S11.

Further, if print data has not been received in S20 (S20: NO), then in S22 the CPU 51 stops driving the main motor 60, in S23 switches the solenoid 61 to the OFF state, and subsequently ends the manually-inserted-sheet-feeding program.

Rotation-Stopping Time Setting Program

Figure 6:
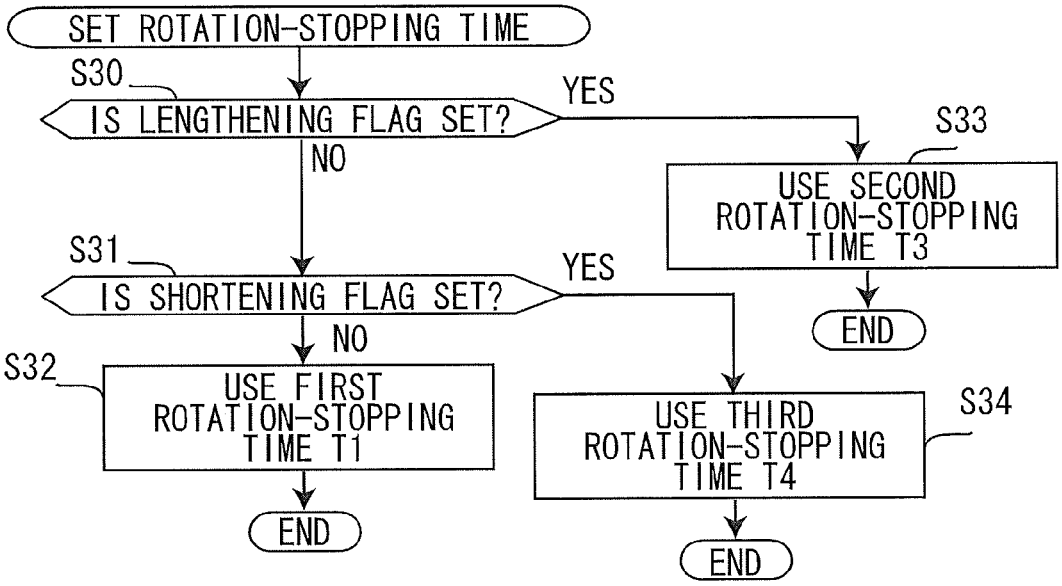
FIG. 6 is a flowchart illustrating steps in a process implemented by a program for setting the rotation-stopping time for a sheet-skew correction roller.

Next, the rotation-stopping time setting program for setting the rotation-stopping time of the sheet-skew correction roller 14A based on the insertion state of the paper 3 will be described. The rotation-stopping time is initially set a first rotation-stopping time T1. In S11 of the manual-paper-feed process, the CPU 51 performs the process shown in FIG. 6 based on a rotation-stopping time setting program. FIG. 6 is a flowchart illustrating steps in a process implemented by a program for setting the rotation-stopping time for the sheet-skew correction roller 14A. In this process, the CPU 51 determines whether a lengthening flag or a shortening flag have been set in the RAM 53. In S30 of FIG. 6 the CPU 51 determines whether the lengthening flag has been set. If the lengthening flag has been set (S30: YES), in S33 the CPU 51 uses a second rotation-stopping time T3, which is longer than the first rotation-stopping time T1, as the rotation-stopping time. If the lengthening flag has not been set (S30: NO), in S31 the CPU 51 determines whether the shortening flag has been set. If the shortening flag has not been set (S31: NO), in S32 the CPU 51 uses the initially set first rotation-stopping time T1 as the rotation-stopping time. However, if the shortening flag has been set (S31: YES), in S34 the CPU 51 uses a third rotation-stopping time T4, which is shorter than the first rotation-stopping time T1, as the rotation-stopping time.

Paper-Withdrawal Monitoring Program

Figure 7:
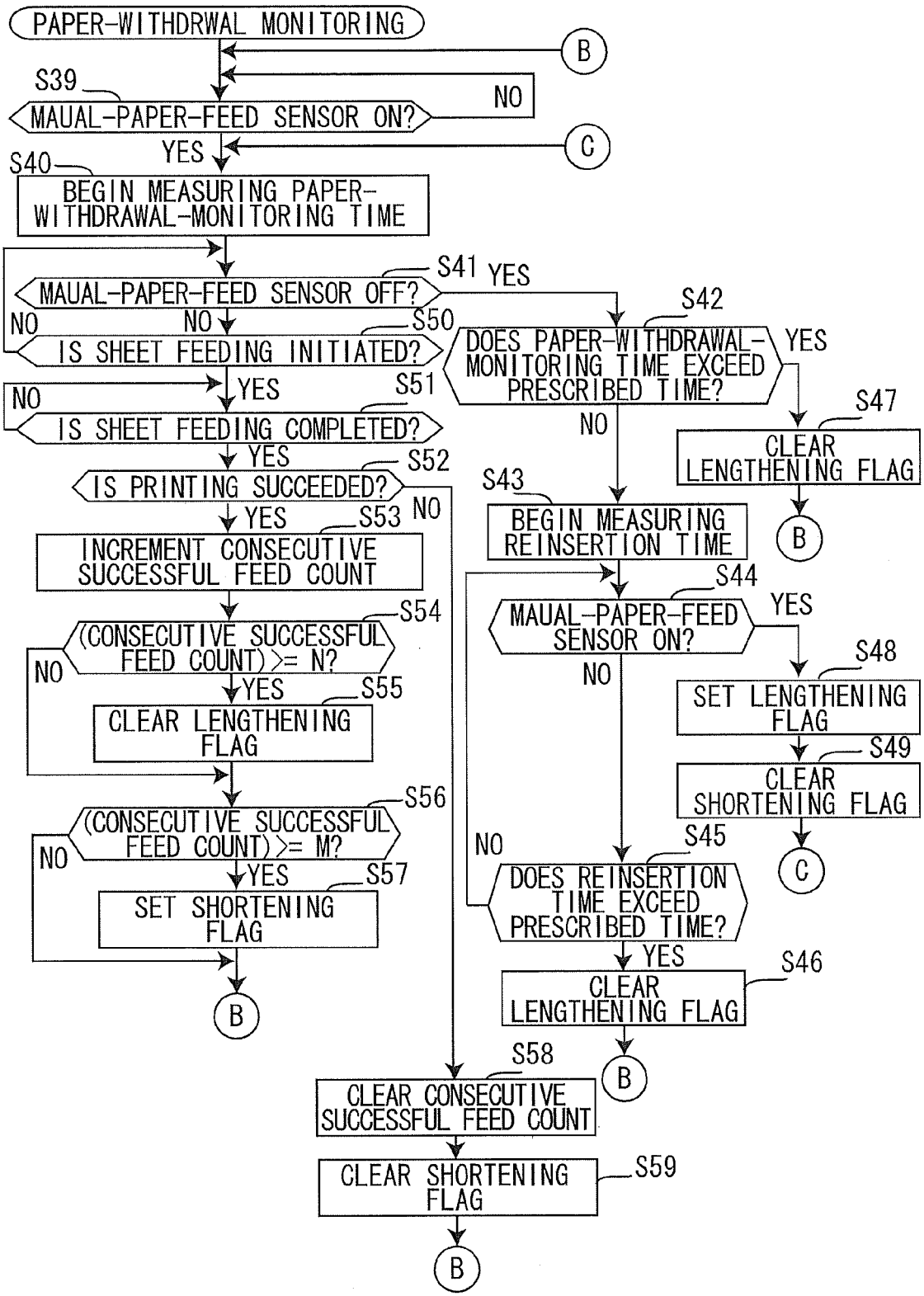
FIG. 7 is a flowchart illustrating steps in a process implemented by a paper-withdrawal monitoring program.
Figure 10:
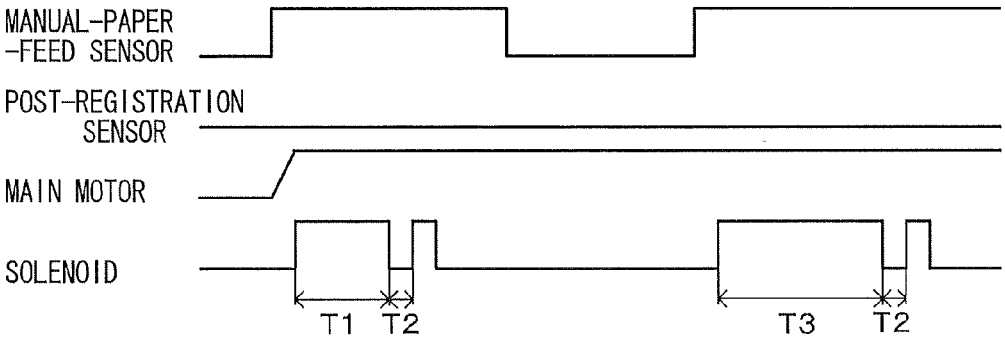
FIG. 10 is a timing chart showing operations of the manual-paper-feed sensor, the post-registration sensor, the main motor, and the solenoid when a sheet of paper has been withdrawn after being pulled in by the sheet-skew correction rollers.

Next, a paper-withdrawal monitoring program will be described. The paper-withdrawal monitoring program is executed for monitoring whether a hand-fed sheet has been withdrawn in order to detect whether the hand-fed sheet has been suitably fed. FIG. 7 is a flowchart illustrating steps in a process implemented by the paper-withdrawal monitoring program. The CPU 51 executes the process shown in FIG. 7 in parallel with the manually-inserted-sheet-feeding program shown in FIG. 5. The paper-withdrawal monitoring program will be described with reference to FIGS. 7, 9, and 10, where FIG. 10 is a timing chart showing the operations of the manual-paper-feed sensor 21, the post-registration sensor 22, the main motor 60, and the solenoid 61 when a sheet of paper has been withdrawn after being pulled in by the sheet-skew correction rollers 14A and 14B. In S39 of FIG. 7 the CPU 51 is in a wait state controlling the manual-paper-feed sensor 21 to monitor the presence of a sheet of paper 3 inserted manually through the manual-sheet-insertion opening 8. If a sheet of paper 3 is detected (S39: YES), in S40 the CPU 51 controls the timer 58 to begin measuring a paper-withdrawal-monitoring time. Paper withdrawal occurs when the user pulls a sheet of paper 3 out of the manual-sheet-insertion opening 8 from the upstream side in the conveying direction thereof after the sheet has been pulled into the main casing 2. If the sheet is skewed upon being drawn into the main casing 2, the user might temporarily withdraw the paper 3 from the main casing 2 and reinsert the paper 3 through the manual-sheet-insertion opening 8. In order to determine whether the sheet has been pulled out of the main casing 2, the CPU 51 measures the time from the point when the manual-paper-feed sensor 21 detects the presence of the paper 3, to the point when the manual-paper-feed sensor 21 no longer detects the presence of the paper 3. The CPU 51 determines that the paper 3 has been pulled out of the main casing 2 when the manual-paper-feed sensor 21 no longer detects the presence of the paper 3 at an unexpected timing for the paper-feeding operation. An unexpected timing is any timing different from the time required for the trailing edge of the paper 3 to pass over the manual-paper-feed sensor 21 in a sheet-feeding operation. For example, the unexpected timing is a timing that occurs before the rotation-stopping time has elapsed.

In S41, the CPU 51 determines whether the manual-paper-feed sensor 21 has changed from the ON state to the OFF state. When determining that the manual-paper-feed sensor 21 has changed from the ON state to the OFF state (S41: YES), the CPU 51 determines that the user has attempted to pull the paper 3 out of the main casing 2, and advances to S42. Since the user has attempted to pull the paper 3 out of the main casing 2, the CPU 51 halts the process implemented by the manually-inserted-sheet-feeding program in FIG. 5, which is being executed in parallel, and repeats that process from S10. In S42 the CPU 51 determines whether the measured paper-withdrawal-monitoring time has exceeded a prescribed time. This prescribed time is the time required for the sheet-skew correction rollers 14A and 14B to complete a pull-in operation with the paper 3 after the CPU 51 determined that the manual-paper-feed sensor 21 switched from the OFF state to the ON state, for example. This time is equivalent to the time required for performing steps from S10 to S19 in FIG. 5. If the paper-withdrawal-monitoring time exceeds the prescribed time (S42: YES), i.e., if the sheet-skew correction rollers 14A and 14B complete an operation to pull in the sheet of paper 3 and the sheet was subsequently pulled out after being left for a relatively long time, in S47 the CPU 51 clears the lengthening flag and returns to S39 of FIG. 7. The paper 3 may be pulled out of the main casing 2 a relatively long time after being pulled in if print data is not received after the sheet was inserted through the manual-sheet-insertion opening 8 and pulled into the main casing 2. In this case, the sheet-skew correction rollers 14A and 14B will not initiate a sheet-feeding operation until print data is received. When in S42 the CPU 51 determines that the paper-withdrawal-monitoring time exceeded the prescribed time, it is highly likely that the printing operation for the paper 3 is canceled. Based on this estimation, the CPU 51 is configured to perform the process in S47 to cancel the printing operation for the paper 3.

If the paper-withdrawal-monitoring time has not exceeded the prescribed time (S42: NO), i.e., if the sheet of paper 3 has been withdrawn within a relatively short time after the sheet was drawn into the sheet-skew correction rollers 14A and 14B, in S43 the CPU 51 controls the timer 58 to begin measuring a reinsertion time. In other words, if the sheet is withdrawn within a relatively short time after the sheet was drawn in by the sheet-skew correction rollers 14A and 14B, there is a high likelihood that the sheet pulled in by the sheet-skew correction rollers 14A and 14B had skew and that the sheet will be reinserted to correct this skew. In order to detect whether the sheet has been reinserted, in S44 the CPU 51 determines whether the manual-paper-feed sensor 21 has changed from the OFF state to the ON state. If the CPU 51 determines that the manual-paper-feed sensor 21 has changed to the ON state (S44: YES), i.e., if the sheet has been reinserted, in S48 the CPU 51 sets the lengthening flag, in S49 clears the shortening flag, and subsequently returns to S40. Thus, if the sheet has been reinserted, the CPU 51 performs the process in S48 to resume printing on the paper 3. Since the sheet of paper 3 has been withdrawn, it is highly likely that the operation to pull in the sheet was not performed properly. In this case, it is highly likely that the user is not accustomed to performing a manually-inserted-sheet-feeding operation, and thus the CPU 51 enables the user to perform the manually-inserted-sheet-feeding operation properly by extending the rotation-stopping time. In other words, the CPU 51 determines that the manually inserted sheet is not properly conveyed when in S41 the CPU 51 determines the manual-paper-feed sensor 21 has changed from the ON state to the OFF state (that is, when the sheet is withdrawn), and thus, in S48 the CPU 51 sets the lengthening flag. Since the rotation-stopping time is lengthened, the shortening flag is cleared in S49.

When the lengthening flag is set in S48, the second rotation-stopping time T3, which is longer than the first rotation-stopping time T1, is applied in S33 of FIG. 6. As shown in FIG. 10, when the CPU 51 detects that the user performed first an operation to insert a sheet of paper 3 and then an operation to withdraw the sheet and subsequently detects that the sheet has been reinserted, the CPU 51 halts rotation of the sheet-skew correction roller 14A by setting the solenoid 61 to the ON state until the second rotation-stopping time T3 has elapsed.

When the CPU 51 determines in S44 that the manual-paper-feed sensor 21 has not changed from the OFF state to the ON state (S44: NO), then the CPU 51 determines in S45 whether the reinsertion time exceeds a prescribed time. If the reinsertion time does not exceed the prescribed time (S45: NO), the CPU 51 returns to S44 and waits for the paper 3 to be reinserted by repeating the processes in S44 and S45. If the sheet is not reinserted before the prescribed time has elapsed (S45: YES), in S46 the CPU 51 clears the lengthening flag and returns to S39. The prescribed time used in S45 is the time required for the user to reinsert the paper 3 and may be set to 2 seconds, for example. Because the sheet is withdrawn before the sheet-skew correction roller 14A initiates the sheet-feeding operation (S41: YES), and the sheet is not reinserted (S44: NO), it is highly likely that the printing operation for the paper 3 is canceled. Based on this estimation, the CPU 51 is configured to perform a process in S46 to cancel the printing operation for the paper 3.

On the other hand, when the CPU 51 determines in S41 that the manual-paper-feed sensor 21 has not changed from the ON state to the OFF state (S41: NO), indicating that the sheet was not withdrawn from the main casing 2, then in S50 the CPU 51 determines whether the sheet-skew correction roller 14A has initiated the sheet-feeding operation. The CPU 51 makes the determination in S50 regarding whether the sheet-skew correction roller 14A has initiated the sheet-feeding operation based on the determination in S21 of the concurrently executing manually-inserted-sheet-feeding program of FIG. 5 regarding whether the sheet-skew correction roller 14A has begun feeding the sheet. If the sheet-feeding operation has not begun (S50: NO), the CPU 51 repeats the process in S41. When the sheet-feeding operation has begun (S50: YES), in S51 the CPU 51 determines whether the sheet-feeding operation has completed. The CPU 51 repeatedly performs the determination in S51 while the sheet-feeding operation has not completed (S51: NO) and advances to S52 when determining that the sheet-feeding operation has completed (S51: YES).

Figure 8:
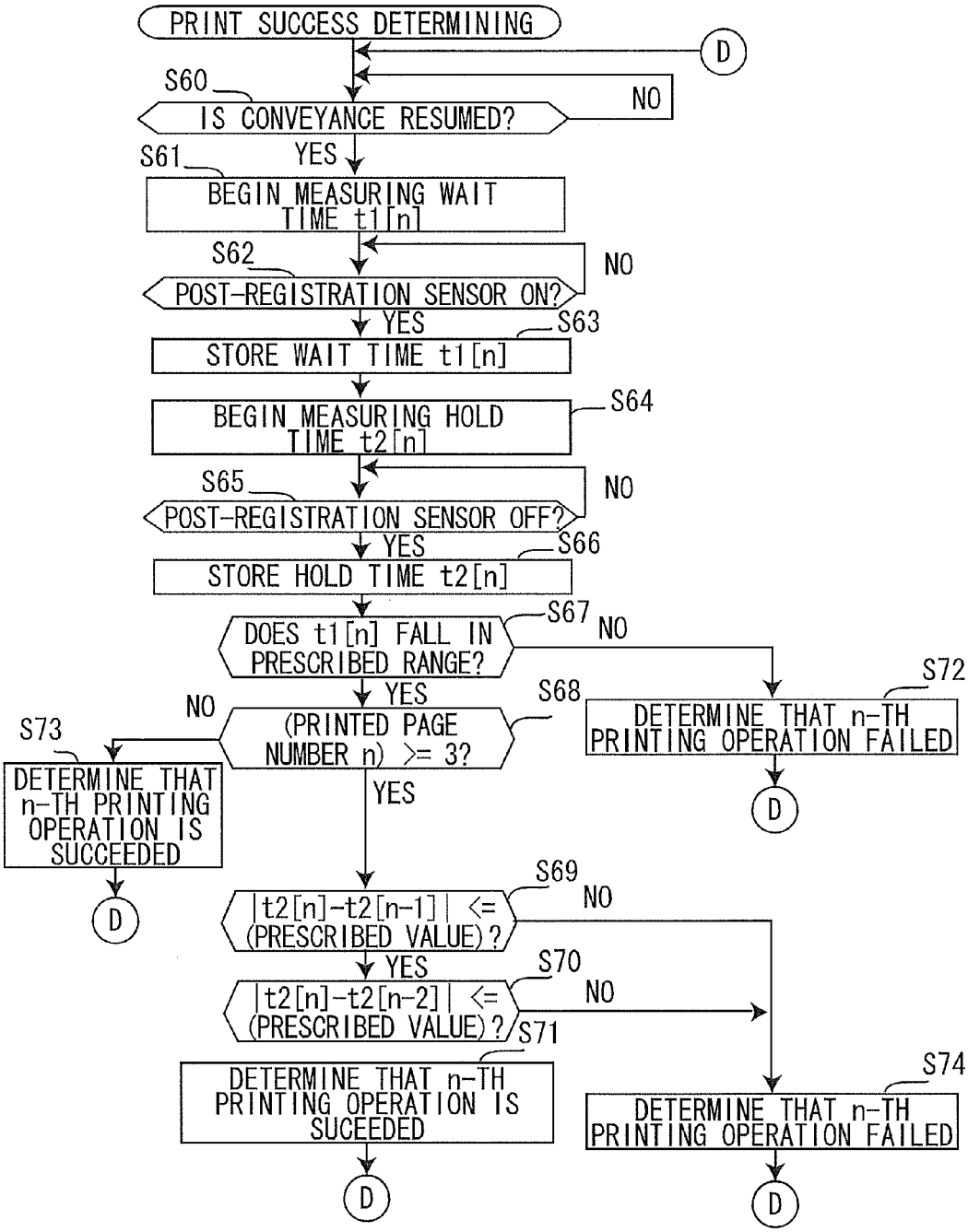
FIG. 8 is a flowchart illustrating steps in a process implemented by a print-success determining program.

In S52 the CPU 51 determines whether the printing operation was a success. This determination is made using a process implemented by the print-success determining program shown in FIG. 8. FIG. 8 is a flowchart illustrating steps in the process implemented by the print-success determining program. This process will be described later. If the CPU 51 determines that printing was a success (S52: YES), in S53 the CPU 51 increments a consecutive successful feed count. This consecutive successful feed count is stored in the RAM 53 and is incremented each time one page is successfully printed in succession.

In S54 the CPU 51 determines whether the incremented consecutive successful feed count is greater than or equal to a prescribed number N. Here, the prescribed number N is an integer larger than zero. In this example, the prescribed number N is set to an integer larger than one, such as, 3. If the consecutive successful feed count is greater than or equal to the prescribed number N (S54: YES), then in S55 the CPU 51 clears the lengthening flag as it is highly likely that the user inserting the sheets of paper 3 is accustomed to the manually-inserted-sheet-feeding operation. Hence, this prescribed number N is the condition for clearing the lengthening flag. If the consecutive successful feed count is smaller than the prescribed number N (S54: NO) or after the process of S55 has been executed, in S56 the CPU 51 determines whether the consecutive successful feed count is greater than or equal to a prescribed number M. Here, the prescribed number M is an integer larger than zero. In this example, the prescribed number N is set to an integer larger than the prescribed number N, such as, 5. If the consecutive successful feed count is greater than or equal to the prescribed number M (S56: YES), in S57 the CPU 51 sets the shortening flag. However, if the consecutive successful feed count is smaller than the prescribed number M (S56: NO) or after executing the process of S57, the CPU 51 returns to S39. Hence, the prescribed number M is the condition for setting the shortening flag. When the consecutive successful feed count is greater than or equal to the prescribed number M (S56: YES), the CPU 51 can shorten the time required to perform the sheet-feeding operation by shortening the rotation-stopping time under the assumption that the user is accustomed to the manually-inserted-sheet-feeding operation, thereby improving the efficiency of the sheet-feeding operation.

When the lengthening flag is cleared in S55 while the shortening flag has not been set, the rotation-stopping time is changed from the second rotation-stopping time T3, which is longer than the first rotation-stopping time T1, as illustrated in FIG. 10, back to the first rotation-stopping time T1 according to the rotation-stopping time setting program shown in FIG. 6. If the lengthening flag is cleared in S55 and the shortening flag set in S57, then the rotation-stopping time is changed to the third rotation-stopping time T4, which is shorter than the first rotation-stopping time T1, as illustrated in FIG. 9, according to the rotation-stopping time setting program shown in FIG. 6. In this case, the sheet-skew correction roller 14A begins the operation to draw in the sheet of paper 3 after the third rotation-stopping time T4 has elapsed, which is much quicker than after the first rotation-stopping time T1 has elapsed, enabling the laser printer 1 to perform a more efficient sheet-feeding operation for users accustomed to the manually-inserted-sheet-feeding operation. Further, if the CPU 51 determines in S52 that the printing was unsuccessful (S52: NO), in S58 the CPU 51 clears the consecutive successful feed count, in S59 clears the shortening flag, and subsequently returns to S39.

Print-Success Determining Program

Next, a process implemented by the print-success determining program will be described with reference to FIG. 8. The print-success determining program determines whether a printing operation on a hand-fed sheet of paper 3 was performed successfully and is executed concurrently with the execution of S19 in FIG. 5. In S60 at the beginning of the process implemented by the print-success determining program, the CPU 51 determines whether an operation to resume conveyance of the sheet of paper 3, which was stopped with its leading edge positioned just before the post-registration sensor 22, has begun. The CPU 51 repeatedly performs the determination in S60 while the conveyance has not been resumed (S60: NO). Here, the CPU 51 determines whether conveyance of the sheet has been resumed based on whether the process in S24 of FIG. 5 has been performed, i.e., based on whether the solenoid 61 has been switched from the ON state to the OFF state to begin a sheet-feeding operation with the sheet-skew correction rollers 14A and 14B. In other words, the CPU 51 determines that the sheet-skew correction rollers 14A and 14B have resumed conveyance of the sheet of paper 3 when determining that the solenoid 61 has changed from the ON state to the OFF state.

Once the sheet-skew correction rollers 14A and 14B have resumed conveyance of the paper 3, in S61 the CPU 51 begins measuring a wait time t1[n] until the sheet of paper 3 is detected by the post-registration sensor 22. In S62 the CPU 51 determines whether the post-registration sensor 22 is in the ON state. The CPU 51 repeatedly performs the determination in S62 while the post-registration sensor 22 is not in the ON state (S62: NO). When the CPU 51 determines that the post-registration sensor 22 is in the ON state (S62: YES), in S63 the CPU 51 stores the wait time t1[n] in the RAM 53. The wait time t1[n] is the time from the point when conveyance of the sheet resumes, to the point when the post-registration sensor 22 detects the sheet, and falls within a prescribed range if the sheet was properly pulled in according to the manually-inserted-sheet-feeding program of FIG. 5.

In S64 the CPU 51 begins measuring a hold time t2[n] indicating how long the post-registration sensor 22 is kept in the ON state. In other words, the hold time t2[n] is the time from the point when the post-registration sensor 22 is placed in the ON state, to the point when the post-registration sensor 22 is switched to the OFF state. That is, the time beginning when the leading edge of the paper 3 passes over the post-registration sensor 22 and ending when the trailing edge of the paper 3 passes over the post-registration sensor 22. In S65 the CPU 51 determines whether the post-registration sensor 22 has switched to the OFF state. The CPU 51 continually repeats the determination in S65 while the post-registration sensor 22 has not switched to the OFF state (S65: NO). When determining that the post-registration sensor 22 has switched to the OFF state (S65: YES), in S66 the CPU 51 stores the hold time t2[n] in the RAM 53.

In S67 the CPU 51 determines whether the wait time t1[n] falls within a prescribed range. The prescribed range is a tolerable range of time required for the post-registration sensor 22 to detect a sheet of paper 3 from a point when the sheet was properly drawn in according to the manually-inserted-sheet-feeding program, in a case where conveyance of the sheet is resumed. The CPU 51 determines that the sheet was not properly drawn in according to the manually-inserted-sheet-feeding program if the wait time t1[n] exceeds the prescribed range. Hence, if the wait time t1[n] does not fall within the prescribed range (S67: NO), in S72 the CPU 51 determines that the $n^{th}$ printing operation failed and returns to S60. In other words, the CPU 51 determines that the manually inserted sheet is not properly conveyed when in S67 the CPU 51 determines that the wait time t1[n] exceeds the prescribed range. If the wait time t1[n] falls within the prescribed range (S67: YES), the CPU 51 advances to S68.

In S68 the CPU 51 determines whether a printed page number n is greater than or equal to 3. If the printed page number n is smaller than 3 (S68: NO), in S73 the CPU 51 determines that the $n^{th}$ printing operation was successful and returns to S60. If the printed page number n is greater than or equal to 3 (S68: YES), in S69 the CPU 51 determines whether the absolute value of the difference between the hold time t2[n] for the $n^{th}$ sheet and the hold time t2[n−1] for the $(n-1)^{th}$ sheet is smaller than or equal to a prescribed value. This prescribed value is preset based on the allowable variation between the $n^{th}$ and $(n-1)^{th}$ sheets. The time required for the sheet of paper 3 to pass over the post-registration sensor 22 differs according to an inclination angle of the paper 3. The inclination angle is the angle at which the sheet of paper 3 is skewed relative to the direction of conveyance. When the inclination angle is large, the degree of skew in the paper 3 is great and the paper 3 will require more time to pass over the post-registration sensor 22. Thus, the prescribed value is set based on the inclination angle that is determined to be allowable. For example, if the inclination angle between the $n^{th}$ and $(n-1)^{th}$ sheets is set to an allowable value of 8 degrees and the conveying speed for an A4-size sheet of paper 3 is calculated at 120 mm/s, the prescribed value is set to 24 MS.

If the absolute value of the difference between the hold time t2[n] for the $n^{th}$ sheet and the hold time t2[n−1] for the $(n-1)^{th}$ sheet is greater than the prescribed value (S69: NO), in S74 the CPU 51 determines that the $n^{th}$ printing operation failed and returns to S60. In other words, the CPU 51 determines that the manually inserted sheet is not properly conveyed when in S69 the CPU 51 determines that the absolute value of the difference between the hold time t2[n] for the $n^{th}$ sheet and the hold time t2[n−1] for the $(n-1)^{th}$ sheet is greater than the prescribed value. However, if the absolute value of the difference between the hold time t2[n] for the $n^{th}$ sheet and the hold time t2[n−1] for the $(n-1)^{th}$ sheet is smaller than or equal to the prescribed value (S69: YES), in S70 the CPU 51 determines whether the absolute value of the difference between the hold time t2[n] for the $n^{th}$ sheet and the hold time t2[n−2] for the $(n-2)^{th}$ sheet is smaller than or equal to the prescribed value. The prescribed value used in S69 is also used in the determination of S70.

If the absolute value of the difference between the hold time t2[n] for the $n^{th}$ sheet and the hold time t2[n−2] for the $(n-2)^{th}$ sheet is greater than the prescribed value (S70: NO), in S74 the CPU 51 determines that the $n^{th}$ printing operation failed. In other words, the CPU 51 determines that the manually inserted sheet is not properly conveyed when in S74 the CPU 51 determines that the absolute value of the difference between the hold time t2[n] for the $n^{th}$ sheet and the hold time t2[n−2] for the $(n-2)^{th}$ sheet is greater than the prescribed value. However, if the absolute value of the difference between the hold time t2[n] for the $n^{th}$ sheet and the hold time t2[n−2] for the $(n-2)^{th}$ sheet is smaller than or equal to the prescribed value (S70: YES), in S71 the CPU 51 determines that the $n^{th}$ printing operation was a success and returns to S60.

By using the hold time t2[n−1] for the previously fed sheet and the hold time t2[n−2] for the sheet fed before the previously fed sheet, the CPU 51 can more accurately determine whether the current sheet was drawn in properly and can determine whether the sheet-feeding operation for the hand-fed sheet was performed reliably.

Variations of the Embodiment

While the invention has been described in detail with reference to the embodiment thereof, it would be apparent to those skilled in the art that various changes and modifications may be made therein without departing from the scope of the invention.

In the embodiment described above, a solenoid 61 is used to control the rotation of the sheet-skew correction roller 14A, but this control may be implemented using an electromagnetic clutch known in the art.

Part of the configuration of the invention implemented in hardware in the embodiment described above may be replaced by software and, conversely, part of the configuration of the invention implemented in software may be replaced by hardware.

In S68 the CPU 51 determines whether a printed page number n is greater than or equal to 3. However, in S68 the CPU 51 determines whether a printed page number n is greater than or equal to a predetermined number. In this case, the predetermined number is an integer greater than or equal to 2. In this case, if the positive determination is made in S68, the process proceeds to S69 whereas if the negative determination is made in S68, the process proceeds to S73.

What is claimed is:

1. An image-forming device comprising:

a first sensor configured to detect a recording sheet manually inserted from a manual sheet insertion opening;

an image forming portion configured to form an image on the recording sheet;

a sheet-skew correction roller configured to correct skew of the recording sheet and convey the recording sheet to the image forming portion in a conveying direction, the sheet-skew correction roller being provided on a downstream side of the first sensor in the conveying direction; and a controller configured to control the sheet-skew correction roller to begin rotating if a stopping time has elapsed from a moment when the first sensor detects the recording sheet, wherein the stopping time is initially set to a first stopping time, the controller being configured to function as:

a determining unit configured to determine whether the recording sheet is properly conveyed or is not properly conveyed, wherein the determining unit is configured to determine that the recording sheet is properly conveyed when the first sensor does not detect an absence of the recording sheet before the first stopping time has elapsed from the moment when the first sensor detects the recording sheet, and wherein the determining unit is configured to determine that the recording sheet is not properly conveyed when the first sensor detects an absence of the recording sheet before the first stopping time has elapsed from the moment when the first sensor detects the recording sheet; and a changing unit configured to change the stopping time to a second stopping time from the first stopping time if the determining unit determines that the recording sheet is not properly conveyed, the second stopping time being longer than the first stopping time.

2. The image-forming device according to claim 1, wherein the changing unit is configured to change the stopping time from the second stopping time to the first stopping time, if the determining unit determines that a recording sheet is properly conveyed while the stopping time is the second stopping time.

3. The image-forming device according to claim 1, wherein the changing unit is configured to change the stopping time from the second stopping time to the first stopping time, if the image forming unit forms the image on the recording sheet once while the stopping time is the second stopping time.

4. The image-forming device according to claim 1, wherein the changing unit is configured to change the stopping time from the first stopping time to a third stopping time shorter than the first stopping time, if the determining unit determines that a recording sheet is properly conveyed while the stopping time is the first stopping time.

5. The image-forming device according to claim 1, wherein the changing unit is configured to change the stopping time from the second stopping time to the first stopping time, if the determining unit determines that a prescribed number of recording sheets are properly conveyed while the stopping time is the second stopping time.

6. The image-forming device according to claim 1, wherein the changing unit is configured to change the stopping time from the first stopping time to a third stopping time shorter than the first stopping time, if the determining unit determines that a prescribed number of recording sheets are properly conveyed while the stopping time is the first stopping time.

7. An image-forming device comprising:

a first sensor configured to detect a recording sheet manually inserted from a manual sheet insertion opening;

an image forming portion configured to form an image on the recording sheet;

a sheet-skew correction roller configured to correct skew of the recording sheet and convey the recording sheet to the image forming portion in a conveying direction, the sheet-skew correction roller being provided on a downstream side of the first sensor in the conveying direction;

a second sensor disposed on a downstream side of the sheet-skew correction roller in the conveying direction and configured to detect the recording sheet; and a timer configured to track a detected amount of time during which the second sensor detects the recording sheet; and a controller configured to control the sheet-skew correction roller to begin rotating if a stopping time has elapsed from a moment when the first sensor detects the recording sheet, wherein the stopping time is initially set to a first stopping time, the controller being configured to function as:

a determining unit configured to determine whether the recording sheet is properly conveyed or is not properly conveyed, wherein the determining unit is configured to determine that the recording sheet is properly conveyed when a difference of detected times between at least the recording sheet and another recording sheet is within a prescribed range, and wherein the determining unit is configured to determine that the recording sheet is not properly conveyed when the difference of the detected times between at least the recording sheet and the other recording sheet is beyond the prescribed range; and a changing unit configured to change the stopping time to a second stopping time from the first stopping time if the determining unit determines that the recording sheet is not properly conveyed, the second stopping time being longer than the first stopping time.

8. The image-forming device according to claim 7, wherein the changing unit is configured to change the stopping time from the second stopping time to the first stopping time, if the determining unit determines that a recording sheet is properly conveyed while the stopping time is the second stopping time.

9. The image-forming device according to claim 7, wherein the changing unit is configured to change the stopping time from the second stopping time to the first stopping time, if the image forming unit forms the image on the recording sheet once while the stopping time is the second stopping time.

10. The image-forming device according to claim 7, wherein the changing unit is configured to change the stopping time from the first stopping time to a third stopping time shorter than the first stopping time, if the determining unit determines that a recording sheet is properly conveyed while the stopping time is the first stopping time.

11. The image-forming device according to claim 7, wherein the changing unit is configured to change the stopping time from the second stopping time to the first stopping time, if the determining unit determines that a prescribed number of recording sheets are properly conveyed while the stopping time is the second stopping time.

12. The image-forming device according to claim 7, wherein the changing unit is configured to change the stopping time from the first stopping time to a third stopping time shorter than the first stopping time, if the determining unit determines that a prescribed number of recording sheets are properly conveyed while the stopping time is the first stopping time.

* * * * *